US005440802A

United States Patent [19]

Whitney et al.

[11] Patent Number: 5,440,802

[45] Date of Patent: Aug. 15, 1995

[54] METHOD OF MAKING WIRE ELEMENT CERAMIC CHIP FUSES

[75] Inventors: Stephen Whitney, Manchester; Vernon Spaunhorst, Washington; Joan Winnett, St. Louis; Varinder Kalra, Chesterfield, all of Mo.

[73] Assignee: Cooper Industries, Houston, Tex.

[21] Appl. No.: 302,999

[22] Filed: Sep. 12, 1994

[51] Int. Cl.[6] ..... H01H 69/02

[52] U.S. Cl. ..... 29/623; 29/411; 29/850; 264/61; 337/227; 337/297

[58] Field of Search ..... 29/623, 411, 850; 264/61; 337/186, 187, 227, 228, 232, 297

[56] References Cited

U.S. PATENT DOCUMENTS

| | | | |
|---|---|---|---|
| 4,607,316 | 8/1986 | Wada et al. | 264/61 |
| 4,669,416 | 6/1987 | Delgado . | |
| 4,873,506 | 10/1989 | Gurevich | 29/623 |
| 5,095,297 | 3/1992 | Perreault et al. . | |
| 5,097,246 | 3/1992 | Cook et al. . | |
| 5,166,656 | 11/1992 | Badihi et al. . | |
| 5,228,188 | 7/1993 | Badihi | 29/623 |
| 5,276,963 | 1/1994 | Flanders | 264/61 |
| 5,296,833 | 3/1994 | Breen et al. . | |

FOREIGN PATENT DOCUMENTS

| | | | |
|---|---|---|---|
| 2068657 | 8/1981 | United Kingdom | 29/623 |

*Primary Examiner*—P. W. Echols

*Attorney, Agent, or Firm*—Burns, Doane, Swecker & Mathis

[57] ABSTRACT

A method of manufacturing a chip fuse includes the steps of depositing a plurality of columns of electrically conductive metal film on a green, unfired ceramic substrate, and disposing a plurality of wire elements on the substrate over the film columns and perpendicular to the film columns. A cover of green, unfired ceramic is bonded to the substrate over the wire elements and film columns to form a laminate. The laminate is then die cut into individual fuses, which are then fired to cure the ceramic and form an intermetallic bond between the wire elements and the metal film. End termination coatings are then applied to the fuses to facilitate connecting the fuses in an electrical circuit. The invention relates to a chip fuse manufactured according to the method.

12 Claims, 3 Drawing Sheets

METHOD OF MAKING WIRE ELEMENT CERAMIC CHIP FUSES

FIELD OF THE INVENTION

The present invention relates to a circuit protector. More particularly, the present invention relates to a method of manufacturing subminiature surface mounted circuit protectors having a wire fuse element. The invention also relates to a subminiature circuit protector having a wire fuse element.

BACKGROUND AND SUMMARY OF THE INVENTION

Subminiature circuit protectors are useful in applications in which size and space limitations are important, for example, on circuit boards for electronic equipment, for denser packing and miniaturization of electronic circuits.

Ceramic chip type fuses are typically manufactured by depositing layers of metal elements on a ceramic or glass substrate plate, attaching an insulating cover over the deposited layers, and cutting, or dicing, individual fuses from the finished structure. The Cutting operation is difficult and expensive to carry out. In addition, subminiature fuses made with deposited film fuse elements are generally limited to low voltage and current interrupting capacity.

The present invention, generally, provides a method of manufacturing a subminiature surface mountable circuit protector that is simple and relatively inexpensive. The present invention also provides a subminiature circuit protector that has improved short circuit current interrupting capacity compared to conventional circuit protectors of similar physical size.

More particularly, the present invention provides a method of manufacturing a multiplicity of subminiature circuit protectors from a plate of substrate material that facilitates the formation and rapid cutting of the substrate into individual units.

According to the present invention, a substrate plate of green, or unfired, ceramic material is prepared. Electrically conductive metallic film is deposited on a top surface of the substrate plate in equally spaced, parallel columns. Fuse elements, in the form of electrically conductive wires, are disposed on the top surface of the substrate perpendicular to the film columns, in equally spaced parallel rows. A second plate of green ceramic material is laminated to the substrate over the film columns and wire elements rows. The second plate covers and encapsulates the film columns and wire rows. The thus formed structure is then die cut, that is, cut, longitudinally through the metal film columns and transversely between the wire rows so that individual units are produced having strips of metal film at opposite ends and a wire element extending from end to end across a space between the metal film strips. The die cut individual units are fired to cure the ceramic substrate and cover plate and to cause an intermetallic bond to form between the wire elements and the metal film. The ends of the individual units are coated with electrically conductive materials to form electrical terminations for connecting in a circuit.

According to one aspect of the invention, the wire elements may be applied to the substrate by rolling and pressing the wire into the substrate. The application of pressure imbeds the wire elements in the substrate and helps form contact between the wire elements and the metallic film.

According to another aspect of the invention, the laminate structure is die cut so that the individual units formed have opposite ends faces and opposite lateral faces. A metal strip at each opposite end of each unit extends to the end face and to both lateral faces so that the electrical termination coatings applied to the units contact the metal strips on the end and lateral faces.

According to yet another aspect of the invention, the end termination coatings comprise a first coating of silver or a silver alloy. A second coating of nickel is applied over the first coating. A third coating of a tin/-lead alloy is applied over the nickel coating.

BRIEF DESCRIPTION OF THE DRAWING FIGURES

The present invention can be further understood with reference to the following description in conjunction with the appended drawings, wherein like elements are provided with the same reference numerals.

DETAILED DESCRIPTION OF PREFERRED EMBODIMENTS

Figure 1:
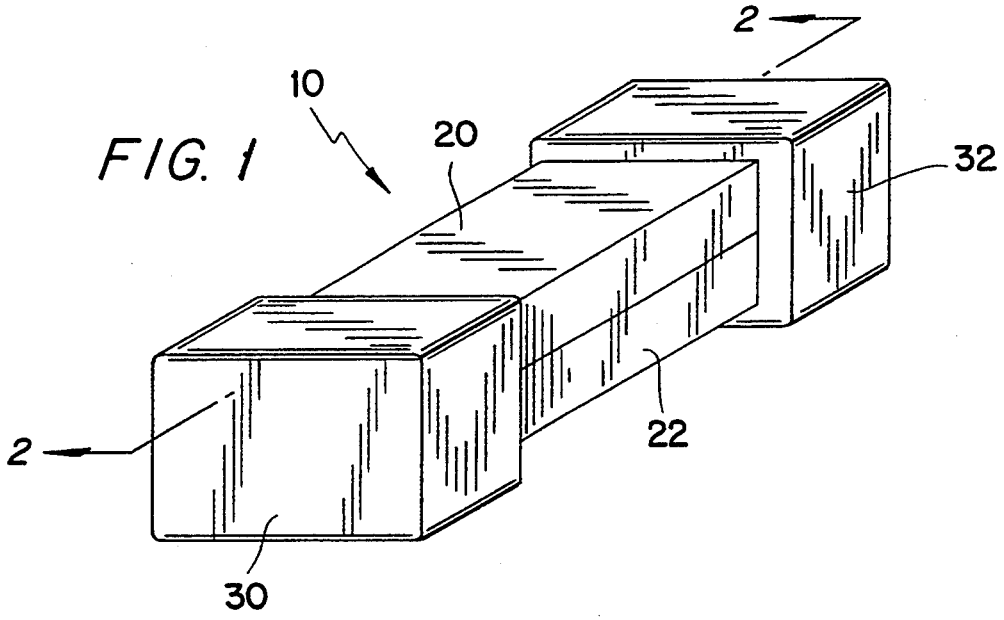
FIG. 1 is a perspective view of a circuit protector manufactured according to the present invention.

FIG. 1 is a perspective view of a subminiature circuit protector 10, or fuse, manufactured according to the method of the present invention. The fuse 10 includes an upper plate 20 and a lower plate 22 laminated together. End terminations 30, 32, at opposite ends of the fuse 10 electrically connect with the interior components of the fuse 10, not illustrated in this figure. The end terminations 30, 32 also allow the fuse 10 to be connected in an electric circuit.

Figure 2:
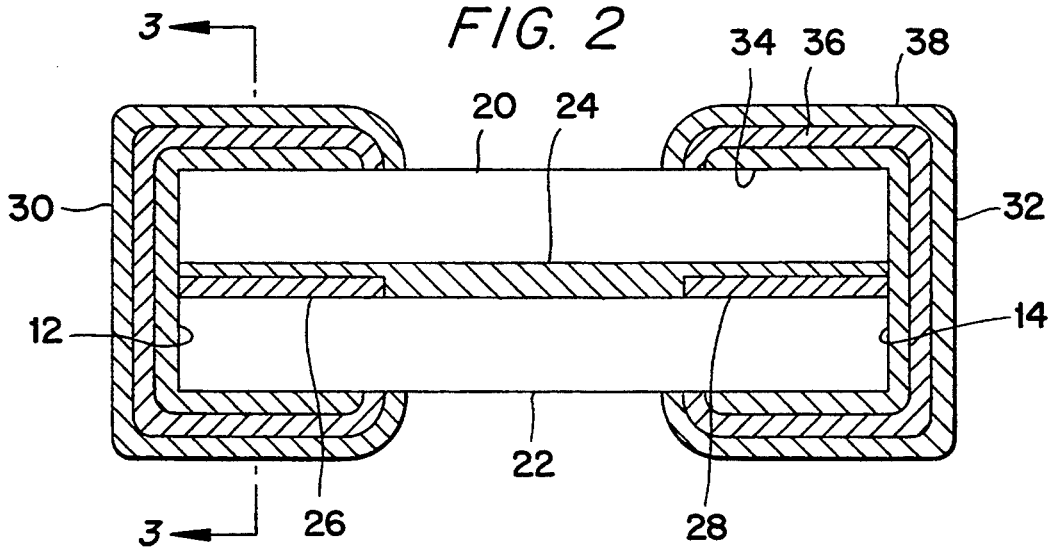
FIG. 2 is a sectional view of the circuit protector of FIG. 1 taken along line 2—2.
Figure 3:
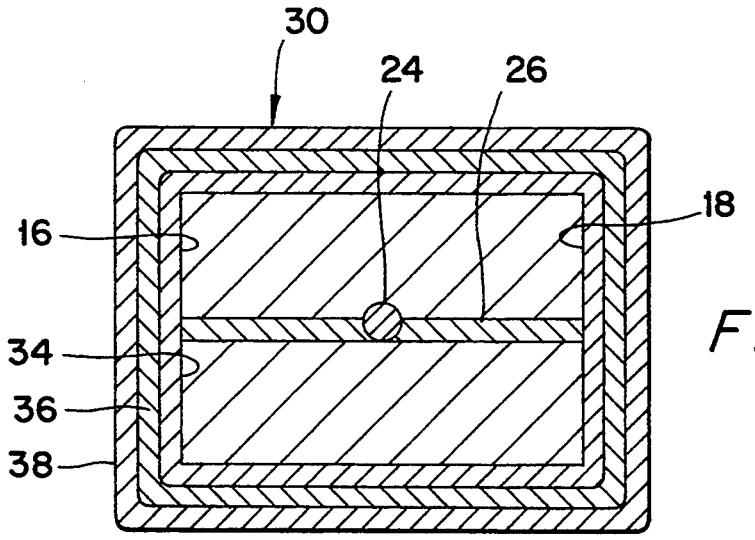
FIG. 3 is a sectional view of the circuit protector taken along line 3—3 of FIG. 2.

FIG. 2 is a sectional view of the fuse 10 of FIG. 1 taken along the line 2—2 of FIG. 1. FIG. 3 is a sectional view taken along the line 3—3 of FIG. 2. Between the upper plate 20 and the lower plate 22 of the fuse 10 is disposed a fuse element 24 that extends from one end face 12 to an opposite end face 14 of the fuse. The fuse element 24 is in the form of a wire. Strips of metal film 26, 28 are disposed at end portions of the fuse 10 in contact with opposite ends of the wire fuse element 24. The metal strips 26, 28 each extend to one end face 12 (or 14) of the fuse 10 and to both lateral faces 16, 18. The metal strips 26, 28 contact the end terminations 30, 32 at the end faces 12, 14 and the lateral faces 16, 18 to form an electrical connection through the fuse 10.

The end terminations 30, 32 are formed of three layers of electrically conductive material. A first, or inner layer 34, comprises a coating of silver or a silver alloy. A second layer 36 comprises nickel and a third layer 38 comprises a layer of tin/lead alloy that facilitates connecting the fuse 10 in an electrical circuit by soldering or other suitable means.

The wire fuse element 24 may be selected to have a desired diameter to provide a predetermined response to current and voltage.

Figure 4:
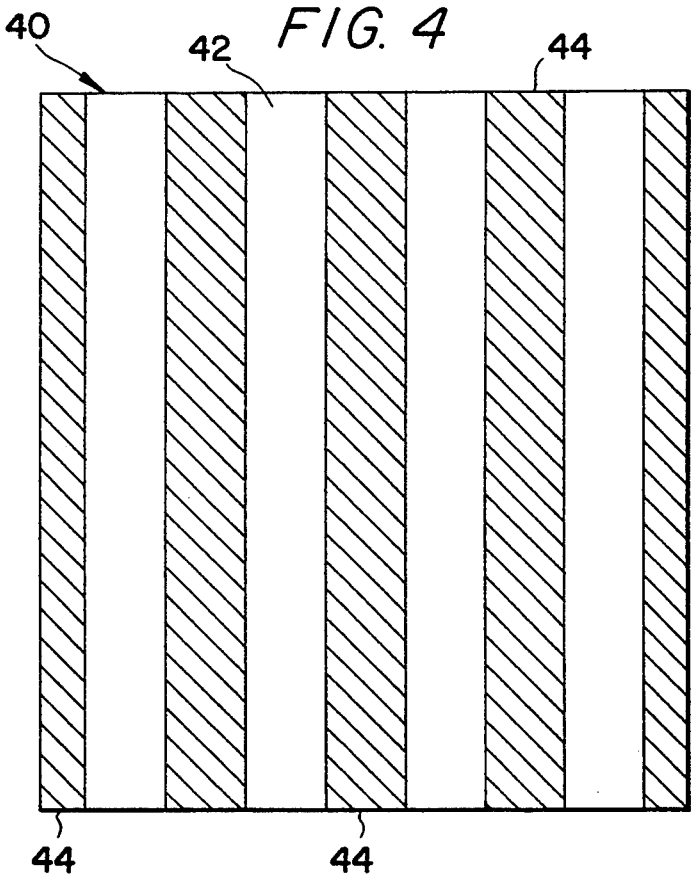
FIG. 4 is a top view of a substrate plate illustrating a depositing step of the present invention.

FIGS. 4–7 illustrate a method of manufacturing the fuse 10 of the present invention. The method permits the manufacture of a multiplicity of individual fuses starting with a single substrate plate. FIG. 4 is a top view of a substrate ceramic plate 40 illustrating initial steps of the method. According to the present invention, a substrate plate 40 of green, or unfired, ceramic material having an upper surface 42 is first prepared. Electrically conductive metal film is deposited on the upper surface 42 as a plurality of parallel, spaced columns 44. The metal film columns 44 may be applied by screen printing or another suitable method.

Figure 5:
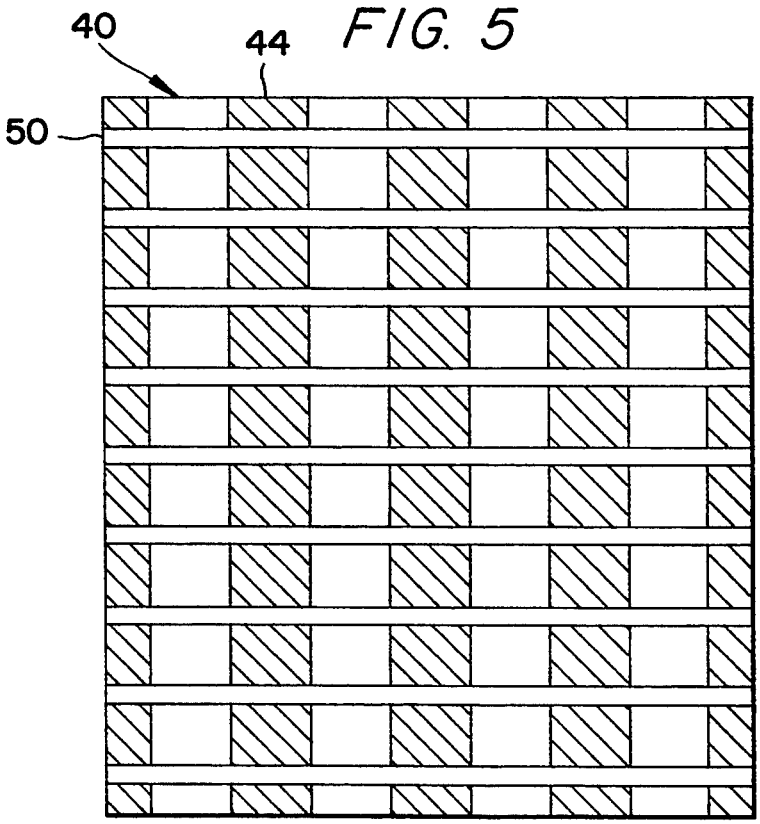
FIG. 5 is a top view of the substrate plate of FIG. 4 after a subsequent step.

FIG. 5 is a top view of the substrate plate 40 of FIG. 4 illustrating a subsequent step of the method. After the metal film columns 44 are deposited on the upper surface 42, a plurality of wire elements 50 are disposed on the upper surface 42 perpendicular to the metal film columns 44, and in mutually spaced relationship. The wire elements 50 extend across and contact the metal film columns 44. In a preferred embodiment of the method, the wire elements 50 are applied with a rolling applicator which moves across the substrate plate 40 and imbeds the wire element in the substrate as it travels. The wire elements 50 may also be applied by another suitable method.

The wire elements 50 may also be pressed into the upper surface 42 of the substrate plate 40. Green ceramic material is relatively soft and pliable, and pressing the wire elements 50 imbeds the wire elements 50 in the substrate plate 40 to help secure it in place. Pressing the wire elements 50 also helps to make good contact between the wire elements 50 and the metal film 44.

Figure 6:
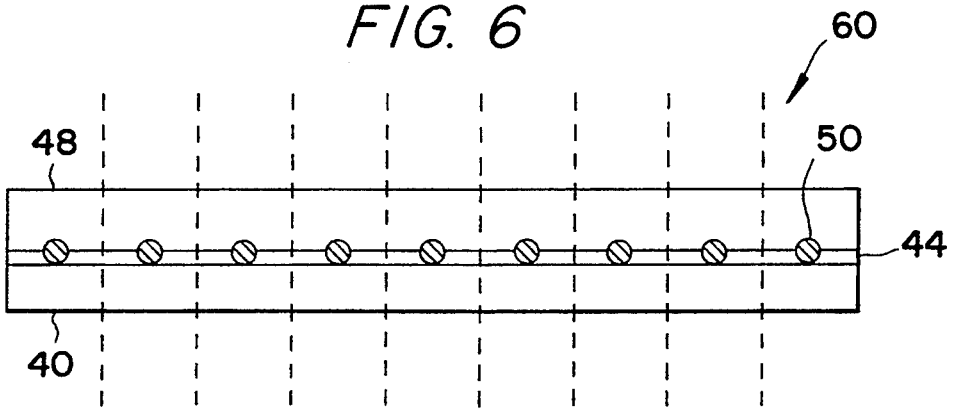
FIG. 6 is an end view of a laminate structure of the substrate plate of FIGS. 4 and 5 and a cover plate.
Figure 7:
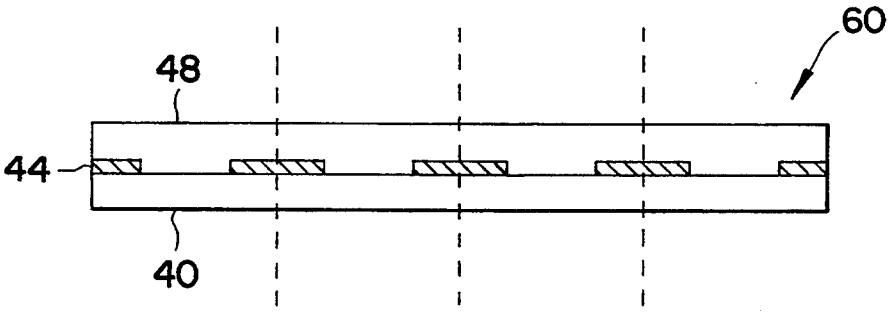
FIG. 7 is an end view of the laminate structure of FIG. 6 perpendicular to the view of FIG. 6.

After the metal film columns 44 and the wire element rows 50 are in place on the upper surface 40 of the substrate, a second plate 48 of green ceramic material is laminated on the upper surface 42 of the lower plate 40, as shown in FIG. 6 and FIG. 7. FIGS. 6 and 7 are end views of the laminate structure 60. The second plate 48 covers and encapsulates the wire elements 50 and the metal film columns 44. As shown in FIGS. 6 and 7, the wire elements 50 and the metal film columns 44 extend to end faces of the laminate structure.

Figure 8:
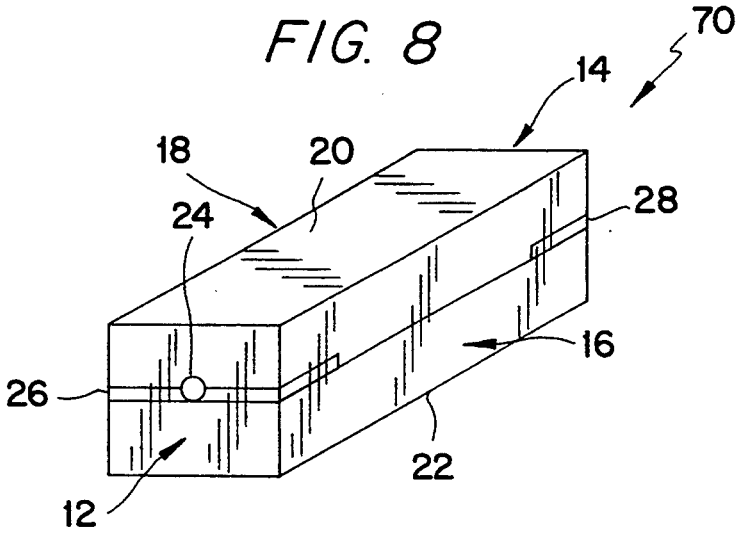
FIG. 8 is a perspective view of an individual fuse unit produced from the laminate structure of FIGS. 6 and 7.

The laminate structure 60 is then die cut to produce individual fuse units. FIG. 8 illustrates an individual unit 70 cut from the laminate structure 60. A steel rule die, or other suitable tool, is used to cut the laminate structure 60 along the broken lines illustrated in FIGS. 6 and 7. Each individual unit 70 produced has strips 26, 28 of the metal film at opposite end portions and a wire element 24 extending from one end face 12 to an opposite end face 14. As illustrated, the metal strips 26, 28 also extend to the end faces 12, 14 and to the opposite lateral faces 16, 18 of the unit.

Die cutting the laminate structure 60 is facilitated by the unfired condition of the ceramic cover 48 and substrate 40, which are relatively soft and easily cut in that state. The die cutting operation is thus performed with lower power required than in conventional methods. In addition, there is less loss due to breaking the ceramic during the cutting operation.

The die cut individual units are then fired as is known in the art to cure the ceramic material. During firing, the heat causes an intermetallic bond to form between the wire elements 50 and the metal film 44, creating a reliable connection.

The individual units 70 are then coated with end terminations to form the fuse 10 of FIGS. 1–3. According to a preferred embodiment of the invention, the individual units 70 are positioned by conventional vibratory sorting means in a fixture having a multiplicity of holes for holding the units. The units are held in parallel in the fixture, and the opposite end portions 12, 14 at which the wire elements 50 terminate are dipped and coated with electrical conducting material in one or more steps.

The foregoing has described the preferred principles, embodiments and modes of operation of the present invention; however, the invention should not be construed as limited to the particular embodiments discussed. Instead, the above-described embodiments should be regarded as illustrative rather than restrictive, and it should be appreciated that variations, changes and equivalents may be made by others without departing from the scope of the present invention as defined by the following claims.

What is claimed:

1. A method for making chip fuses, comprising the steps of:

depositing a plurality of spaced, parallel columns of electrically conductive film on an upper surface of a green ceramic plate;

disposing a plurality of electrically conductive wire elements on the upper surface of the plate in mutually parallel spaced relationship and substantially perpendicular to the film columns;

bonding a cover plate of unfired ceramic material to the upper surface of the plate, the cover plate covering the film columns and wire elements to form a laminate structure;

dividing the laminate structure to form a plurality of individual fuses; and firing the fuses to cure the ceramic and to create an intermetallic bond between the wire elements and the conductive metal film at mutual points of contact.

2. The method according to claim 1, wherein the step of dividing the laminate structure into individual fuses is performed so that each fuse includes strips of metal film at opposed end portions and a wire element connecting the strips.

3. The method according to claim 2, wherein the step of dividing the laminate structure is performed so that each fuse includes opposite end faces and opposite lateral faces and each strip of metal film extends to one end face and both lateral faces.

4. The method according to claim 1, further comprising the step of applying at least one layer of an electrical termination coating to opposite end portions of the fuses after the firing step.

5. The method according to claim 4, wherein the step of applying a termination coating is performed so that the layer contacts a portion of the metal film extending to an end face and opposite lateral faces of the fuse.

6. The method according to claim 4, wherein a first coating step includes applying a layer of a silver alloy.

7. The method according to claim 4, wherein a second coating step includes applying a layer of nickel over a first termination coating layer.

8. The method according to claim 4, wherein a third coating step includes applying a layer of a tin/lead alloy over a second termination coating layer.

9. The method according to claim 1, wherein the step of depositing the conductive metal film is by screen printing.

10. The method according to claim 1, wherein the step of disposing the wire elements is by rolling.

11. The method according to claim 1, further comprising the step of pressing the wire elements into the surface of the substrate.

12. The method according to claim 1, wherein the step of dividing the laminate structure is by cutting the laminate with a steel rule die.

* * * * *